United States Patent [19]

Lange et al.

[11] Patent Number: 4,884,708

[45] Date of Patent: Dec. 5, 1989

[54] PRESSURE VESSEL

[75] Inventors: Ernst W. Lange, Mettmann; Karl Scholl, Oberhausen; Dieter Vespermann, Moers, all of Fed. Rep. of Germany

[73] Assignee: Mannesmann AG, Duesseldorf, Fed. Rep. of Germany

[21] Appl. No.: 259,999

[22] Filed: Oct. 19, 1988

[30] Foreign Application Priority Data

Oct. 26, 1987 [DE] Fed. Rep. of Germany ..... 3736579

[51] Int. Cl.[4] ..... B65D 81/20; B65D 85/84

[52] U.S. Cl. ..... 220/3; 206/0.6; 206/524.5; 220/5 A

[58] Field of Search ..... 206/0.6, 0.7, 524.5, 206/524.6; 220/3, 5 A

[56] References Cited

U.S. PATENT DOCUMENTS

| | | | |
|---|---|---|---|
| 1,801,910 | 4/1931 | Dumat | 220/3 |
| 2,118,388 | 5/1938 | Zerbe | 220/3 |
| 2,661,113 | 12/1953 | Benson | 220/3 |
| 2,679,454 | 5/1954 | Offenhauer | 220/3 |
| 2,685,546 | 8/1954 | Gibb, Jr. | 220/3 |

FOREIGN PATENT DOCUMENTS

| | | | |
|---|---|---|---|
| 0834859 | 2/1952 | Fed. Rep. of Germany . | |
| 3103646 | 8/1982 | Fed. Rep. of Germany . | |
| 3614290 | 10/1987 | Fed. Rep. of Germany . | |
| 0043663 | 4/1978 | Japan | 220/3 |
| 0730271 | 5/1955 | United Kingdom . | |

OTHER PUBLICATIONS

"Unmagnetischer Druckasbehalter", Walter Meissner, Aug., 1960, (in German).

*Primary Examiner*—Jimmy G. Foster
*Attorney, Agent, or Firm*—Ralf H. Siegemund

[57] ABSTRACT

A pressure vessel for the storage of gas has a bottom part, a cylindrical jacket and a head part with a neck, these parts are made of a corrosionproof stainless steel having up to 0.06% C, from 1.5 to 6% Mn, from 0.3 to 1% Si, from 16 to 25% Cr, from 4 to 18% Ni, from 0 to 4% Mb, from 0 to 0.35% nitrogen, from 0 to 0.25% Nb, all percentages by weight, the remainder being iron with the conventional low level impurities; following shaping, the interior surfaces are electrochemically polished; a valve with an adapter is provided for adapting dimensions of the valve to the neck, and a protective cap is threaded onto an upper portion of the head part; through welding or a non welded e.g. a threaded connection the adaptor is connected to the valve, and a nut or welding connection connects the adaptor to the neck.

34 Claims, 3 Drawing Sheets

PRESSURE VESSEL

BACKGROUND OF THE INVENTION

The present invention relates to a pressurized vessel, bottle, container or the like for the storage and supply of noble gas, special gas, blends or mixture of gases particularly of the kind required to exhibit a high degree of purity; and more particularly the invention relates to a pressure vessel of such a type which includes a bottom, a jacket, or main part and head part with a neck portion provided for receiving a valve to be covered by a protective cap. Vessels of the type to which the invention pertain, moreover, require a configuration readily admitting treatment of the interior surface for eliminating any surface roughness.

Generally speaking the electronic industry and other fields of art employ certain gases during production and for certain production purposes and phases a gas or gases of a high degree of purity is required. These gases have to be stored and are usually transported in steel flasks, bottles, vessels, containers etc. but it was found that here there may be certain contamination i.e. impurities that enter the gas filled interior of the bottle to have the effect of changing the concentration of the components. These impurities may render questionable from some point onwards further utilization of the stored gas. These conditions are particularly important in the semiconductor field and involve corrosive combustible gases.

Generally speaking it it known that the surface roughness as well as the cleanliness of the interior surface of such a pressure vessel is a direct factor for maintaining the purity and the stability of the mixture or blend of the gas stored in that vessel. Moreover, the material itself used for the bottle, vessel, flask or container has a certain influence on maintaining purity of its content. For economic reasons it is required that during transport as well as storage the gases are stored at a high pressure which is to be maintained. This in turn requires that a material for the container, flask or bottle be used which has sufficient strength to withstand the high pressure. Strength requirements are fulfilled by the usual steel bottles including unalloyed or low alloyed steel. On the other hand these bottles in accordance with the state of the art no longer suitable for the now required degrees of purity and corrosion resistance.

Generally speaking it has been recognized that the gas impurity content is reduced the lower the internal surface roughness of the container. Hence smoothing the surface is a direct factor that eliminates, to some extent at least, long term impurity growth in the container. In order to provide as smooth an interior surface as possible German printed patent application 23 64 377 proposes to electrolytically tin plate such a bottle in its interior or to provide for a zinc plating process, assuming that the container is made of ferritic pertitic steel. In another publication it has been suggested to blast the interior surface with quartz balls or globules and to clean it chemically or with ultrasound.

DESCRIPTION OF THE INVENTION

It is an object of the present invention to provide a new and improved vessel, bottle, container etc. for pressurized gas with particular emphasis on improving maintaining the purity of the stored gas such as noble gas, special gas blends etc. The vessel and its connection will be provided for taking up gas pressures up to 200 bars and it should not be too expensive.

In accordance with the preferred embodiment it is suggested that the bottom, the jacket and head parts of such a bottle, container, vessel, flask etc. is made of a corrosionproof stainless steel with a consistency of up to 0.06% C, from 1.5 to 6.0% Mn, from 0.3 to 1.0% Si, from 16 to 25% Cr, from 4–18% Ni, possibly up to 4% Mb, possibly up to 0.35% nitrogen, possibly also up to 0.25% Nb, all percentages by weight (mass), the remainder being Fe with the usual low level impurities; following forming the container it is annealed and in order to reduce roughness of the interior surface it is electrochemically polished under utilization of a cathodic dc electrode having, approximately at least, the length of cylindrical jacket of the bottle, container etc. The feeder connection is provided as an adaptor piece being connected to the neck and being provided for connection to a valve. The neck is provided for receiving a protective cap.

The material of the container as proposed is to a high degree chemically resistant against the aggressiveness of all conceivable gases and gas blends. Moreover, this particular material is very suited for galvanic i.e. electrochemical polishing to a high degree of smoothness whereby the active surface is in effect "flattened" and in terms of effective area, the surface is actually drastically reduced as compared with an unpolished condition. This then reduces extensively the absorption effect of gases for depositing on the interior wall of the container and the release of impurities into the gas is likewise avoided to a considerable extent. Moreover, following the electropolishing the interior surface is quite free from any mechanical internal residual tension and stress as it may have appeared and arisen during manufacturing. This reduces the tendency sorption of the material.

Instead of the usual standardized conical thread in the neck one inserts the adaptor and connects to the neck through a nut and is secured against turning. Between adaptor on one hand and front end surface of the vessel on the other hand a corrosionproof metallic sealing is inserted. This arrangement has the advantage that the adaptor being locked against turning will be upon act only by process and will not cause any abrasion. For preventing rotation of the adaptor one can provide a number of possibilities such as an even number multiple edge section in the form of secants, for receiving an appropriate key or another suitable tool to be provided for the valve end of the adaptor; or one can provide blind bores which extend in axial direction in order to permit insertion of an appropriate key or other tool. The connection of the adaptor with the valve can be provided such that the adaptor is actually welded or soldered to the connecting body of the valve, and the entire arrangement is electropolished by dipping.

A modification here is to be seen in that the connecting part of the valve is threaded in a bore of the adaptor and/or a welding seam is provided at the transition portion, either on the outside or inside or both. The adaptor may be provided in its bore area with a standardized internal thread. Following threading in of the connecting body of the valve the entire arrangement is electropolished. For further securing, as stated, one may provide a sealing seam in the transition area on the outside or the inside or both. A screw connection without a sealing seam would have the advantage that the valve can be exchanged any time while the adaptor can be reused. But if one provides the adaptor as an integral unit with a connection body of the valve then this unit can be threaded without any connecting seam in the neck of the container following the electropolishing procedure.

A threaded nut connection between neck and adaptor was mentioned above. It is also feasible to provide the adaptor unit on one hand and neck on the other hand as an integral unit and the valve body is then provided with a corresponding collar and is secured by threading to the neck of the vessel. Still alternatively to the example given thus far one can seam weld the adaptor directly to the neck of the container. In this case then one does not need the sealing ring as well as the connecting nut. The adaptor can be connected to the valve corresponding to the possibilities mentioned earlier.

The protective cap is threaded onto a portion of the head, having an outer threading whereby this particular portion of the head part is integral therewith. Alternatively is may be shrunken on ring. This separation of fastening the protective cap on one hand and the valve on the other hand makes sure that in case the bottle, flask, container or the like drops accidentally or is hit unintentionally for some reason this shock from the outside will not be effective in the valve as far as the valve connection is concerned.

Finally it should be mentioned that the material for making the adaptor and/or the nut end or the valve do not have to be identical with the material proposed for the vessel. Except of course in those instances where e.g. the adaptor is made integral with the neck portion of the head part. The material therefore which is freely selectable may be elected in view of good cutting and shaping capabilities but on the other hand the material must have at least approximately the same resistance against corrosion and must not reduce the strength of the device as a whole.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
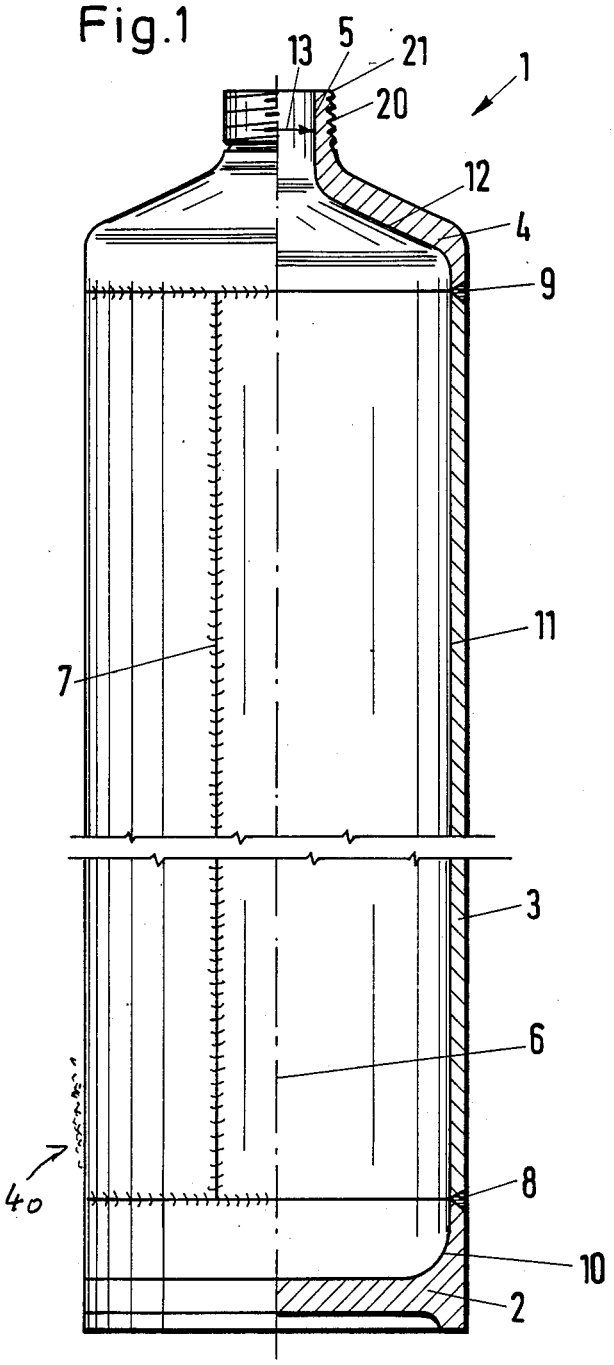
FIG. 1 is a side elevation in the left part and a longitudinal section on the right part of a multipart welded pressure vessel without inserted valve and protective cap.

Proceeding now to the detailed description of the drawings, reference is made first to FIG. 1 showing a pressure vessel 1 which consists of multiple parts which are welded together. These parts are, a cylindrical jacket portion 3, a head part 4 with integral neck 5 as well as a bottom part 2. The particular material is of the type mentioned above and is therefore of a specific corrosionproof stainless steel. This kind of material was found to be particularly suitable for storing special gases, noble gases or blends of such gases each with high degree of purity.

The jacket 3 can be deemed to be configured as tubing made through a longitudinal seam welding; reference numeral 7 in the left hand portion of FIG. 1 denotes this welding seam running in parallel to the axis of the container. This is a matter of practicality; instead one may use a seamless tube for purposes of providing this cylindrical jacket part 3. Bottom 2 and head 4 are respectively connected with the cylindrical jacket 3 through annular welding seams 8 and 9 respectively. The three parts 2,3 and 4 following the respective shaping but prior to welding together are heat treated as stated.

The entire interior surface of the vessel or bottle is composed of the internal surface portions 10, 11 and 12 respectively of bottom 2, cylindrical part 3 and head part 4 including the neck 5. That surface is electropolished after welding in order to reduce the surface roughness to a considerable extent and in order to remove any residual surface tension. In order to carry out this particular method and particularly in view of subsequent refinishing it is necessary to provide the passage through the neck 5 identified by the radius indicating arrow 13 of the neck to be as large as possible, and to provide this neck as smooth as it is constructively possible without any edges, projections or the like. The electropolishing of the surfaces 10, 11 and 12 could be carried out prior to the welding of the parts together whereby however a subsequent electropolishing may be necessary just for the annular seams 8 and 9.

Figure 2:
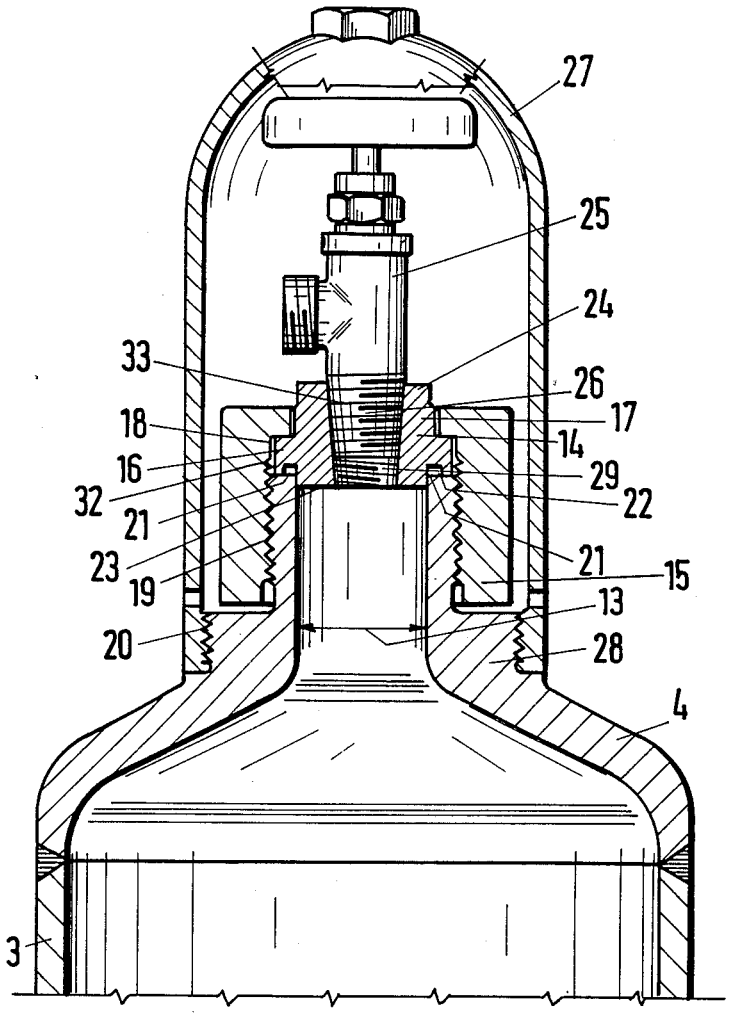
FIG. 2 is a longitudinal section through a connection provided in accordance with the present invention applicable to the vessel, flask or container shown in FIG. 1.
Figure 3:
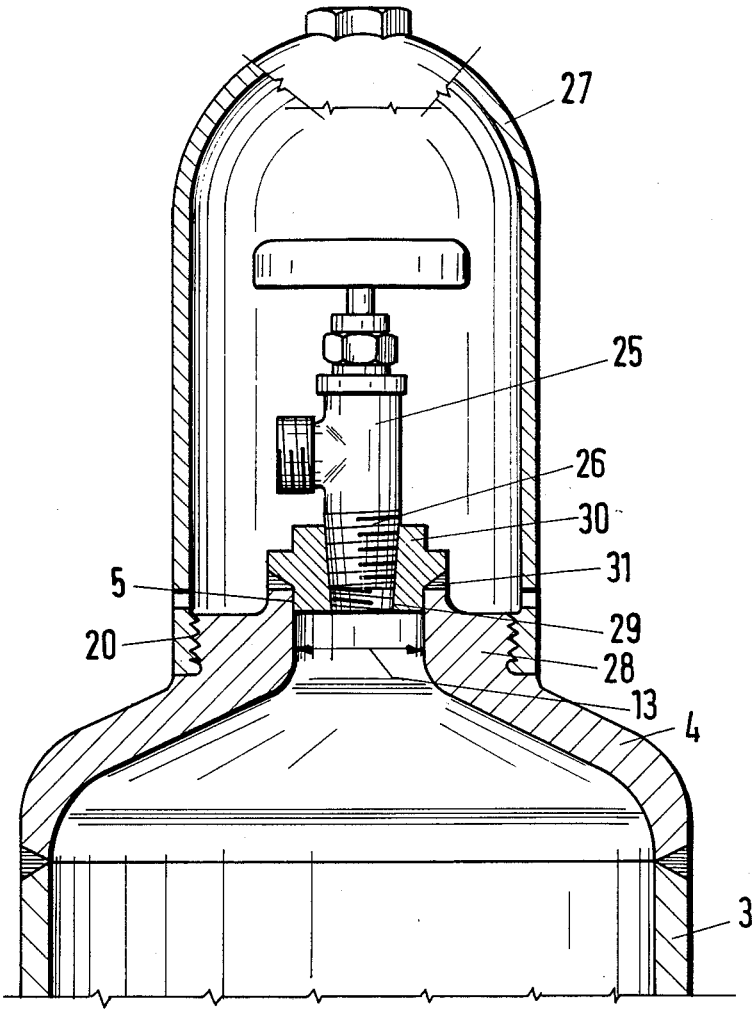
FIG. 3 is a view similar to FIG. 2 but with a welded on adaptor.

The connection of the bottle to the valve, 25, is now illustrated in greater detail by way of example in FIGS. 2, 3 and others. In FIG. 2 an adaptor 14 is provided and configured centrally as a sleevelike hollow element. The adaptor 14 is provided with a collar 16 which extends radially outwardly adjacent to the end of the container. Nut 15 has a shoulder 35 which grips around the collar 16 adjacent the cylindrical part 17 of the adaptor 14 to hold the adaptor against the end of neck 15. The nut 15 has a bore 18 which on the inside is then axially continued in a threading 19 which is threaded onto the outer threading 20 of the neck 5. The nut 15 is thus threaded onto the outer threading of neck 5 of the container 1 to hold the adapter there against it.

Reference numeral 26 refers to a connecting body 26 of a valve 25 which is shown as being threaded into the adaptor 14. As shown in FIG. 2*a*, the connecting body 26 could be integral with the valve 25.

A side of the collar of adaptor 14 facing the front face of the neck 5 is provided with a recess or indent 22 into which has been placed a corrosionproof metallic seal element and packing 32. On turning of the nut 15 the sealing ring 32 is pressed onto the front face 21.

In order to guide and position the adaptor 14 safely a central projection 23 is provided on the side facing the container. This projection 23 has a somewhat smaller diameter than the diameter 13 of the neck 5 itself and is thus freely inserted therein. During turning of the nut 15 there should be not turning of the seal 32 relative to the adaptor 14 in order to avoid abrasion. For this, the end of adaptor 14 near the valve is provided with a cross section 24 that deviates slightly from a circle. In this particular example one provides two secant flattenings facing each other across the diameter so that a particular key or similar tool can be applied. Another cross section can be chosen in order to make sure that the adaptor can be held, e.g. as stated, one could provide two blind bores extending in axial direction but being positioned across the diameter. These bores are then provided for receiving an appropriate key.

In the particular example shown in FIG. 2 a standard valve 25 having its connecting body 26 threaded into the adaptor 14 is used under utilization of the threading 33. Alternatively adaptor 14 can be welded together with the connecting body 26. Together these parts are electropolished however that requires that temporarily the critical and sensitive mechanical valve parts are removed from the valve.

A protective cap 27 is threaded onto an element 28 of the head part 4 carrying an outer threading. This element 28 can be integral with the neck as stated, or it can be configured as a shrunken on ring. Structural separation of the connection of the protective cap 27 and of the valve 25 makes sure that there is no mutual interference in that particularly any impact or the like on the cap 27 is not transmitted upon the critical valve 25 and particularly the sealing 32.

FIG. 3 illustrates a modification of the valve connection to the flask, bottle or container 1 whereby specifically an adaptor 30 is provided for being welded directly to the neck 5 of the container under production of a welding seam 21. FIG. 3c shows further alternative namely the adaptor 30 in this case can be integral with the connecting body 26 of the valve 25. In this case one does not need a nut such as 15 or a seal such as 32 and in the case of a standard valve 25 it is threaded into the adaptor 30. There are other possibilities of connecting the valve to the adaptor which are within the purview of the inventive disclosure and do not require further illustration.

If one assumes that a pressurized vessel is made in accordance with the inventive material to have the usual standardized dimensions then it is convenient to provide polishing by means of dipping. In the case of larger dimensions, however, one can use the vessel 1 itself as a container for the electrolyte used for electropolishing. In either case a cathodic dc electrode of suitable length is inserted into the pressure vessel 1 so that the bottom as well as head part in the case of welded multipart vessel construction the welding and soldering are all polished from the inside. Such a pressure vessel with a relatively high Ni content will be rather heavy, particularly when constructed to withstand higher pressures as far as the stated range and therefore this vessel will be quite expensive. Moreover, a high Ni content after annealing will provide only moderate strength properties.

In accordance with further features of the invention it is suggested to provide in the case of a relatively high Ni content (15 to 18%) additives as follows from 3 to 6% Mn, from 27 to 37% molybdenum, from 0.2 to 0.35% nitrogen, and not more than 0.25 Niobium. For a lower Ni content, 4 to 9% the molybdenum content should be between 0.5 to 3%. Particular possibilities exist to obtain a ferritic austenitic mixed texture with a relatively reduced Ni content and having a relatively low molybdenum content to increase the stretch limit of the material by a factor of about 2.5 as compared with the usual austenitic material.

Another feature for reducing the weight is to provide the vessel 1 as a welded multipart element as is shown and provides cold work strengthening of the cylindrical jacket of the container. For this then a seamless all welded tubing 3 is stretched up to the vicinity of the connection zones by about at least 10% and up to 35% as far as wall thickness is concerned and then head part 4 and bottom part 2 are welded to the stretched container jacket. The connecting portion however will retain the usual or original wall thickness since an annealing of the cold strengthened zone e.g. as a result of welding or soldering, destroys the desired strength increase. Owing to the fact that in some instances the pressure vessel is to be quite long as compared to its diameter one has to say that the stretching e.g. of down to about 5% of the wall thickness does in fact reduce the weight.

Another feature in accordance with the invention for purposes of reducing the weight of the container is to be seen in strengthening the cylindrical part 3 of the vessel 1 from the outwards through a fiber wrapping 40 being applied to the cylindrical part with or without some tension and being covered by a synthetic fibers. Depending on the thickness as far as tension is concerned some of the tension as applied and is effective on the vessel, is in effect taken up by this outer lining 40 and that in turn means that the wall thickness of the metallic part in the cylindrical portion can be and has been reduced. Saving weight can further be improved if the fiber wrapping 40 is combined with cold worked strengthened cylindrical jacket.

The vessel can be made from a seamless single piece or in form of a multiple welded configuration. The advantage of a multiple, welded together configuration is to be seen in that prior to welding them together, the individual parts can be more easily worked. This involves particularly smoothing the mechanical interior surface prior to electropolishing. Alternatively it is possible to electropolish the individual parts of the container prior to welding them together and if necessary the seam areas are subsequently subject to treatment.

The head portion 4 and the bottom portion 2 of a single piece flask or container with integral head and/or bottom part will show small surface cracks which obtain during hot forming and are almost impossible to avoid. During the electropolishing they can be removed only with large effort and not even completely so that the welded formation as shown just for the avoidance of such surface cracks is a better approach. Electropolishing is the more effective and easier to carry out, the smoother the surface has been by way of mechanical polishing. Correspondingly smooth surface is possible even if the single piece container is present made through cold working.

The reduction of surface roughness, particularly regarding the inner surface of the container has to apply also to the connection, otherwise the aim for a significant reduction in particle introduction is no longer valid for the entire system. It is thus necessary to provide and to configure the neck portion of the container in such a manner that it is readily amenable to the electropolishing process. Moreover the connection of the container with the valve 25 must not result in abrasion of the material. Here then in the case of large containers it is suggested to provide the opening or bore in the neck portion, as large as possible, i.e. at least equal preferably larger than 40 mm/diameter.

The invention is not limited to the embodiments described above but all changes and modifications thereof, not constituting departures from the spirit and scope of the invention, are intended to be included.

We claim:

1. Pressure vessel for storage of gas comprising:

a bottom part, a cylindrical jacket and a head part with a neck, said bottom, said jacket and said head part being made of a corrosionproof stainless steel having up to 0.06% C, from 1.5% to 6% Mn, from 0.3 to 1% Si, from 16 to 25% Cr, from 4 to 18% Ni, from 0 to 4% Mb, from 0 to 0.35% nitrogen, from 0 to 0.25% Nb, all percentages by weight, the remainder being iron with the conventional low level impurities, said parts following shaping, having been annealed and its interior surface electrochemically polished under insertion of a cathodic dc electrode having the approximate length of the cylindrical jacket;

a valve;

an adaptor for adapting dimensions of the valve to the neck and being connected to the neck and to said valve; and a protective cap threaded onto an upper portion of said head part of the vessel.

2. Pressure vessel as in claim 1 wherein said jacket, said bottom and said head part are separate pieces and have been soldered or welded together.

3. Pressure vessel as in claim 2, said jacket being a seamless or a welded tube.

4. Pressure vessel as in claim 3 said tube having been stretched by at least 10 to 35% through cold working prior to connection of the head and bottom parts.

5. Pressure vessel as in claim 1 said steel being from 3 to 6% Mn, from 15 to 18% Ni, from 2.7 to 3.7% Mb, from 0.2 to 0.35% nitrogen, and not more than 0.25% Nb, all percentages by weight.

6. Pressure vessel as in claim 1 said steel having from 4 to 9% Ni and from 0.5 to 3% Mb all percentages by weight.

7. Pressure vessel as in claim 1 wherein said jacket part is provided with an outer one or multi-ply fiber wrapping as a lining.

8. Pressure vessel as in claim 7 said fibers being wrapped with synthetic material.

9. Pressure vessel as in claim 1 said adaptor being an essentially cylindrical sleeve.

10. Pressure vessel for storage of gas comprising:

a bottom part, a cylindrical jacket and a head part with a neck, said bottom, said jacket and said head part being made of a corrosionproof stainless steel having up to 0.06% C, from 1.5 to 6% Mn, from 0.3 to 1% Si, from 16 to 25% Cr, from 4 to 18% Ni, from 0 to 4% Mb, from 0 to 0.35% nirogen, from 0 to 0.25% Nb, all percentages by weight, the remainder being iron with the conventional low level impurities, said parts following shaping, having then interior surfaces electrochemically polished;

a valve;

an adaptor for adapting dimensions of the valve to the neck;

first connection means for connecting the adaptor valve;

second connection means for connecting the adaptor to the neck; and a protective cap threaded onto an upper portion of said head part of the vessel.

11. Pressure vessel as in claim 10, said first connection being non-welding connection between adaptor and valve.

12. Pressure vessel as in claim 11, said second connection means being a threaded connection.

13. Pressure vessel as in claim 11, said second connection means being a welding connection.

14. Pressure vessel as in claim 10, said first connection means being a threaded connection.

15. Pressure vessel as in claim 14, said second connection means being a threaded connection.

16. Pressure vessel as in claim 14, said second connection means being a welding connection.

17. Pressure vessel as in claim 16 said adaptor provided with a particular surface for receiving a seal by means of which the adapter is sealed against the neck.

18. Pressure vessel as in claim 10, said first connection means being a welded connection.

19. Pressure vessel as in claim 18, said second connection means being a threaded connection.

20. Pressure vessel as in claim 18, said second connection means being a welding connection.

21. Pressure vessel as in claim 10, said second connection being a threaded connection there being in addition a seal between the adaptor and the neck.

22. Pressure vessel as in claim 10 wherein said valve having a part inserted in a bore of said adapter.

23. Pressure vessel as in claim 10, in that the second connection is a threading connection of the valve to the adapter and a sealing seam being provided in a transition between adaptor and valve.

24. Pressure vessel as in claim 10, the adapter having a centering insertion for being received by the neck.

25. Pressure vessel for storage of gas comprising:

a bottom part, a cylindrical jacket and a head part with a neck, said bottom, said jacket and said head part being made of a corrosionproof stainless steel having up to 0.06% C, from 1.5 to 6 Mn, from 0.3 to 1% Si, from 16 to 25% Cr, from 4 to 18% Ni, from 0 to 4% Mb, from 0 to 0.35% nitrogen, from 0 to 0.25% Nb, all percentages by weight, the remainder being iron with the conventional low level impurities, said parts having their interior surfaces electrochemically polished; a valve; an adaptor for adapting the valve to the neck;

a nut threaded onto the neck to connect the adaptor to the neck;

means for connecting the adaptor to the valve; and a protective cap threaded onto an upper portion of said head part of the vessel.

26. Pressure vessel as in claim 25, the adaptor being prevented against undesired turning.

27. Pressure vessel as in claim 26, said adaptor being provided with a radially outwardly extending cylindrical collar having a nonround outer surface.

28. Pressure vessel as in claim 26 said adaptor being provided with keying surfaces for receiving a tool.

29. Pressure vessel as in claim 26 said adaptor being provided with blind bores for receiving a tool.

30. Pressure vessel for storage of gas comprising:

a bottom part, a cylindrical jacket and a head part with a neck, said bottom, said jacket and said head part being made of a corrosionproof stainless steel having up to 0.06% C, from 1.5 to 6% Mn, from 0.3 to 1% Si, from 16 to 25% Cr, from 4 to 18% Ni, from 0 to 4% Mb, from 0 to 0.35% nitrogen, from 0 to 0.25% Nb, all percentages by weight, the remainder being iron with the conventional low level impurities, said parts following shaping, having their interior surfaces electrochemically polished;

a valve;

an adaptor having the valve threaded into a threaded bore of the adaptor;

means for connecting the adaptor to the neck; and a protective cap threaded onto an upper portion of the head of the vessel.

31. Pressure vessel as in claim 30, the means for connecting being a holding seam.

32. Pressure vessel as in claim 30, the means for connecting being a threaded connection.

33. Pressure vessel as in claim 30 including in addition a seal between the adaptor and the valve.

34. Pressure vessel as in claim 30, the threaded connection being a nut holding the adaptor against the neck and being threaded onto the neck.

* * * * *